United States Patent [19]

Solheim

[11] Patent Number: 4,457,432

[45] Date of Patent: Jul. 3, 1984

[54] INTERLOCKING STACKABLE TRAY

[76] Inventor: Allan D. Solheim, 14032 N. Canterbury Dr., Phoenix, Ariz. 85023

[21] Appl. No.: 554,195

[22] Filed: Nov. 22, 1983

Related U.S. Application Data

[63] Continuation-in-part of Ser. No. 369,599, Apr. 19, 1982.

[51] Int. Cl.[3] ..... B65D 21/02

[52] U.S. Cl. ..... 206/503; 34/237; 206/509; 206/510; 211/126; 220/4 E; 220/345

[58] Field of Search ..... 34/237, 238; 206/503, 206/505, 509, 510, 511, 512; 211/126, 128; 220/4 E, 345

[56] References Cited

U.S. PATENT DOCUMENTS

| | | | |
|---|---|---|---|
| 1,008,239 | 11/1911 | Bunte | 206/509 |
| 1,529,413 | 3/1925 | Anderson | 34/238 |
| 3,534,866 | 10/1970 | Asenbauer | 211/126 |
| 3,700,137 | 10/1972 | Souza | 206/511 |
| 3,968,881 | 7/1976 | Beil et al. | 211/128 |
| 4,226,192 | 10/1980 | Myers | 206/503 |
| 4,234,097 | 11/1980 | Daenen | 206/821 |

FOREIGN PATENT DOCUMENTS

| | | | |
|---|---|---|---|
| 197804 | 1/1978 | France | 206/512 |
| 7502431 | 1/1975 | Netherlands | 206/505 |
| 699100 | 10/1953 | United Kingdom | 206/512 |
| 1211110 | 11/1970 | United Kingdom | 206/509 |

*Primary Examiner*—William T. Dixson, Jr.
*Assistant Examiner*—Jimmy G. Foster
*Attorney, Agent, or Firm*—Herbert E. Haynes, Jr.

[57] ABSTRACT

An interlocking stackable tray having an opposed pair of sidewalls which are especially configured to be inwardly deflected toward each other into interlocked supporting engagement with a similar tray upon stacked placement of the similar tray thereon.

8 Claims, 5 Drawing Figures

INTERLOCKING STACKABLE TRAY

CROSS-REFERENCE TO RELATED APPLICATION

This is a continuation-in-part application of copending U.S. patent application Ser. No. 369,599, filed Apr. 19, 1982, for: INTERLOCKING STACKABLE TRAY, by the same inventor.

BACKGROUND OF THE INVENTION

1. Field of the Invention

This invention relates generally to trays and similar receptacles capable of being stacked on one another, and more particularly to stackable trays which will interlock with one another and permit access to the interior of a given tray disposed within a stack of such trays.

2. Description of the Prior Art

Trays and similar receptacles are often classified as being nestable, stackable, or both nestable and stackable. By nestable is meant that the trays when empty will fit into one another for convenient storage and handling. By stackable is meant that a plurality of trays containing various articles, or materials, can be disposed on top of one another while providing clearance for the articles or materials disposed within the trays. For example, U.S. Pat. No. 1,565,902, issued on Dec. 15, 1925, to J. Brenzinger, discloses a cover for sardine tins and similar containers which can be nested within one another in such a manner as to facilitate separation of the covers. Further, U.S. Pat. No. 2,704,974, issued on Mar. 29, 1955, to G. L. Setman, discloses a tray formed from a piece of sheet metal, and the like, with peripheral portions thereof bent upwardly to create a receptacle which can be nested within other like receptacles. A disadvantage of this tray construction, however, is that while a plurality of such trays can be nested when empty, they cannot be stacked on top of one another when containing articles or materials without directly contacting the contents of this supporting tray.

It is also known to provide trays such as disclosed in U.S. Pat. No. 3,401,828, issued on Sept. 17, 1968, to K. R. Bockenstette, wherein nestable trays can be arranged in opposed pairs so that one tray of a pair serves as a cover for another tray of the same pair, and a plurality of such pairs can be stacked on top of one another. U.S. Pat. No. Reissue 27,649, reissued on May 29, 1973, to A. W. Levenhagen, also discloses a tray construction wherein a plurality of such trays can be either nested or stacked on one another in dependence on the relative orientation of the trays to one another. Although these trays can be stacked on one another in such a manner as to permit retention within each tray of various articles and/or materials being handled, and the trays are interlocked with one another, the trays must still nest into one another to a certain extent in order to provide an interlock between the trays, thus eliminating part of the usable space of the tray except for the tray on top of the stack, and also making it difficult to view the contents of a particular tray in a stack of such trays.

U.S. Pat. No. 4,211,324, issued on July 8, 1980, to R. C. Ohlbach, discloses a receptacle or tray construction wherein a plurality of trays can be stacked on top of one another in interlocking relation by use of a plurality of tabs extending from the bottom of each of the trays so as to eliminate the necessity of the trays themselves actually extending into a tray on which it is stacked. Norwegian Pat. No. 106,411, published May 31, 1965 to White Eagle International, Inc. also discloses a tray or receptacle which is stackable in an interlocking manner by resting on an upwardly extending rim of a like tray.

Two basic disadvantages encountered with known stackable trays, however, is that the interlocking arrangement is usually carried out by an upper tray extending into a socket provided in an upper portion of a supporting tray, and that generally no provision is made to determine the contents of a tray below the uppermost tray in a stack. Further, the known stackable trays generally are supportable only on one another and are not conveniently manipulated or supported in suitable rack structures.

SUMMARY OF THE INVENTION

It is an object of the present invention to provide a tray which interlocks with other like trays in a stack by positive gripping action.

It is another object of the present invention to provide an interlocking stackable tray which can be readily manipulated and supported in a suitable rack structure.

Still another object of the present invention is to provide a stackable tray in which the contents of a given tray are visually ascertainable, and even physically obtainable, while the tray is disposed in a stack of such trays.

Yet another object of the present invention is to provide a stackable tray which can be conveniently manipulated even though constructed in a simple and economical manner from lightweight materials.

These and other objects are achieved according to the present invention by providing an interlocking, stackable tray comprising a bottom wall, a pair of substantially parallel, coextensive sidewalls, extending codirectionally from the bottom wall, and a latch arrangement associated with the sidewalls for grippingly engaging a like tray disposed on the sidewalls. Preferably, the sidewalls are constructed from a resiliently deflectable material, with the latch arrangement being partially formed by such materials.

The bottom wall preferably is substantially planar and generally rectangular in plan and forming an upper surface and a lower surface. Each of the sidewalls includes a planar section arranged to extend angularly upwardly and inwardly from the plane of the bottom wall and defines an upper edge from which an integral ledge extends outwardly so as to normally lie in a plane which angularly slopes toward the plane of the bottom wall of the tray. The outer end of the ledge is provided with an integral lip which extends generally perpendicularly and upwardly therefrom. The planar section, ledge, and lip are constructed from a resiliently deformable material as mentioned above and cooperate to form the latch mechanism by being arranged so that a downwardly applied force exerted proximate the upper edge of the planar section, i.e., the junction of the ledge and the planar section, in a direction substantially perpendicular to the plane of the bottom wall will deflect the entire sidewall inwardly relative to the bottom wall. In this manner, the opposed sidewalls of the tray are arranged for being deflected toward each other when a bottom wall of a like tray is placed on the upper edges of the sidewalls to move the ledges into supporting engagement with the bottom wall of the like tray with the lips of the sidewalls moving therewith to embracingly engage the planar section of like tray being supported thereon. Further, the sidewalls of a tray according to the present invention also are arranged for deflecting toward each other when an upwardly directed force is applied on the outer ends of the ledges of the sidewalls such as by placement of the tray so that its ledges are resting on a suitable support.

A tray according to the present invention preferably also includes at least one end wall arranged substantially perpendicular to the sidewalls, but arranged extending from the bottom wall of the tray codirectional with the sidewalls a distance somewhat less than a distance the sidewalls extends from the same bottom wall for permitting visual, and even physical, access into a given tray when another like tray is stacked thereon.

An advantage of the present invention is that an interlocking is obtained between stacked trays without the necessity of an upper tray being nested into a socket provided in the tray on which it is supported.

Another advantage of the present invention is that a single tray can be supported either on a bottom surface thereof or suspended by ledges which also form convenient carrying and manipulating handles for the tray.

Yet another advantage of the present invention is that the contents of a given tray and a stack of trays can be readily determined without the necessity of removing the trays in question from the stack of trays.

The foregoing and other objects of the present invention as well as the invention itself, may be more fully understood when read in conjunction with the accompanying drawings.

BRIEF DESCRIPTION OF THE DRAWINGS

FIG. 3 is a fragmentary side elevational view showing the manner in which the trays according to the present invention, and as illustrated in FIGS. 1 and 2, interlockingly stack on one another, and can be supported by the bottom of a lower tray on a suitable rack structure, and the like.

DESCRIPTION OF THE PREFERRED EMBODIMENT

Figure 1:
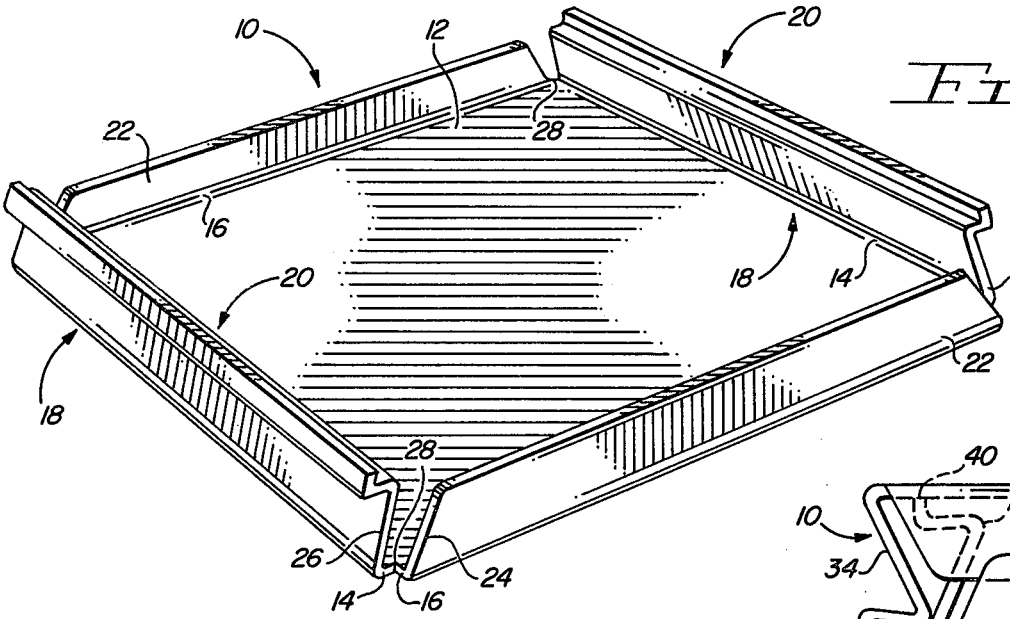
FIG. 1 is a perspective view showing the interlocking stackable tray according to the present invention.

Referring more particularly to the drawings, FIG. 1 shows an interlocking stackable tray 10 in accordance with the present invention as comprising a substantially planar bottom wall 12 of generally rectangular configuration in plan and bordered by perpendicularly disposed pairs of spaced edges 14 and 16. An especially configured pair of substantially parallel, coextensive sidewalls 18 extend from opposed edges 14 of the bottom wall 12 and form a latch arrangement 20 which is designed to grippingly engage a bottom wall of a like tray which is stacked on the sidewalls 18 of the tray 10 in a manner to hereinafter be fully described.

Extending from the opposed pair of edged 16 of the bottom wall 12 and arranged substantially perpendicular to sidewalls 18, are a pair of end walls 22 codirectional with sidewalls 18 a distance substantially less than a distance the sidewalls 18 extend from the bottom wall 12 for permitting visual, and even physical, access into the tray 10 when other trays are stacked thereon. Each of the end walls 22 terminates laterally in an end surface 24 which is slanted from the associated bottom wall 12 so as to converge toward one another and cooperate with a like slanted pair of end surfaces 26 of the sidewalls 18 to form open corners 28. When constructed from a sheet of aluminum, steel, or other suitable metal, it will be appreciated that the tray 10 can be constructed merely by bending upwardly the walls 18 and 22 by techniques well known in the particular art. Further, it is to be understood that the tray 10 can be molded from a suitable synthetic resin, and the like, if so desired. It will also be appreciated that end walls 22 can be reduced in height as desired, and even eliminated if so desired and the intended use of the tray 10 permits, without eliminating the interlocking capability of the latch arrangement 20.

Figure 2:
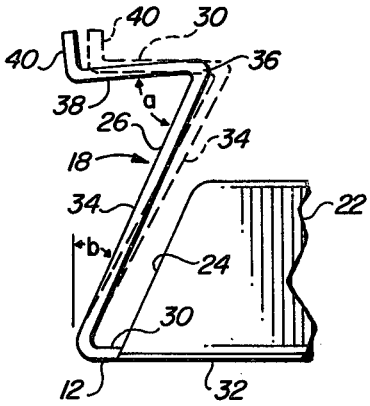
FIG. 2 is a fragmentary side elevational view showing the manner in which the sidewalls of a tray shown in FIG. 1 will deflect to achieve a locking action.

Referring more particularly to FIG. 2 of the drawings, the bottom wall 12 defines an upper surface 30 and a lower surface 32, with each of the sidewalls 18 including a planar section 34 arranged to extend upwardly angularly and inwardly from their respective one of the opposed edges 14 of the bottom wall 12, with the planar section 34 defining an upper end or edge 36. Each of the sidewalls 18 further includes an integral ledge 38 which extends outwardly from the upper end 36 of the planar section 34, and is disposed so as to normally lie in a plane which slopes angularly and downwardly relative to the plane of the bottom wall 12, with a lip 40 being formed on the outwardly extending end of the ledge 38, so as to extend generally perpendicularly and upwardly therefrom. Planar sections 34, ledges 38, and lips 40 of the sidewalls 18, as well as the rest of the tray 10, are fabricated of a resiliently deflectable material, as mentioned above, so that when a force is exerted on the upper ends 36 of the planar sections 34, i.e., the junctions of the planar sections 34 and the ledges 38, in a downward direction which is substantially perpendicular to the bottom wall 12, the opposed sidewalls 18 will be deflected inwardly toward each other. FIG. 2 shows one of the sidewalls 18 in its normal, or undeflected position in solid lines and shows the inwardly deflected position thereof in broken lines.

Figure 3:
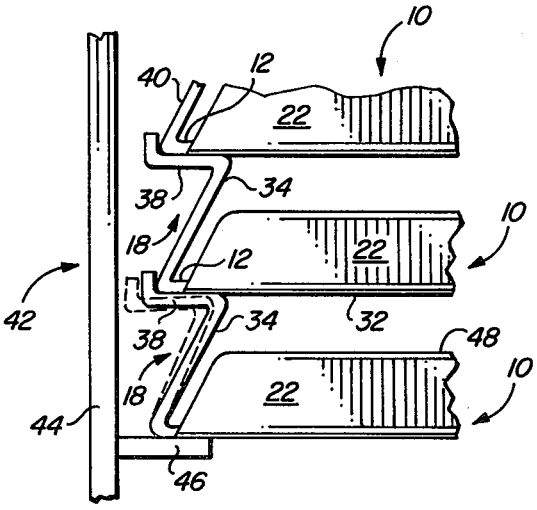

FIG. 3 shows the manner in which the sidewalls 18 of one of the trays 10 will move into supporting interlocking engagement with a like tray 10 when the like tray is stackingly arranged thereon. When the like, or top tray 10 is downwardly lowered toward the tray upon which it is to be stackingly arranged, i.e., the bottom tray, the bottom wall 12 of the top tray will first come into engagement with the upper ends 36 of the planar sections 34 of the sidewalls of the bottom tray. Thus, the entire weight of the top tray will be concentratingly brought to bear on the relatively small surface areas at the upper ends 36 of the opposed sidewalls 18 of the bottom tray. In that the forces resulting from the weight of the top tray are concentrated in the relatively small areas at the upper ends 36 of the planar sections 34, the force per unit area, or pressure, at those upper ends 36 will be high and the sliding friction between the inwardly moving sidewalls of the bottom tray and the bottom wall of the top tray will be relatively low.

As a result of the above described factors, the sidewalls 18 of the bottom tray 10 will be easily moved inwardly toward each other which moves the ledges 38 of the sidewalls into contiguous supporting engagement with the bottom wall of the top tray 10, and will simultaneously move the lips 40 thereof into gripping engagement with the opposed edges 14 of the bottom wall at the junction of the sidewalls of the top tray.

While the angle between the planar sections 34 and associated ledges 38 of the sidewalls 18 are not considered critical, an angle of 68° has been found satisfactory when used in conjunction with an angle of 15° relative to the normal for the planar section 34 relative to an associated bottom wall 12. These angles are indicated by a and b in FIG. 2.

A rack 42, as seen in FIG. 3, of conventional construction including uprights, such as that designated at 44 from which cooperating pairs of shelves 46 (one of which is illustrated in FIG.3) can extend cantileverwise, can be used to support a lowermost of a stack of trays 10 according to the present invention. Although not illustrated, it will be appreciated that such a stack of trays could be supported on a table, floor, or other suitable surface.

Figure 4:
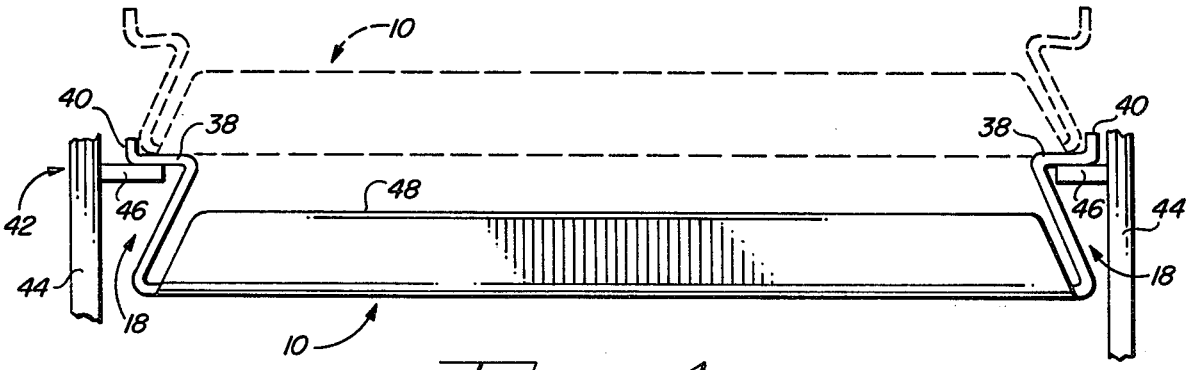
FIG. 4 is a fragmentary side elevational view showing the manner in which a tray according to the present invention can be suspended from a suitable rack structure.

Alternatively, trays 10 can be supported as illustrated in FIG. 4 by resting the lower surfaces of the ledges 38 of a tray 10 on shelves 46 of the rack 42. As shown by broken lines in FIG. 4, a further tray 10 can be stacked atop the supported tray 10 due to the inward deflection of the sidewalls 18 caused by the upwardly directed force applied at the extending edges of the ledges 38 from the shelves 46 and the downwardly directed force of the upper tray 10. Thus, the upper tray 10 will be grippingly engaged by the lips 40 of the sidewalls 18 of the supported tray 10 in the manner hereinbefore fully described.

Further, the same action which causes the suspended tray 10, as illustrated in FIG. 4, to grippingly engage a like tray 10 stacked thereon will cause a stack of trays to remain interlocked even when manually manipulated by picking the trays up by the ledges 38 of the lowermost tray 10 in the stack in a manner not illustrated.

Figure 5:
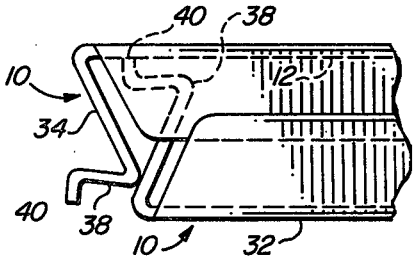
FIG. 5 is a fragmentary, elevational view showing one tray according to the present invention being used as a cover for another like tray.

FIG. 5 shows the manner in which the tray 10 can be inverted into a like tray 10 to form a cover for it. This feature particularly is advantageous for conserving space during storage of the trays 10, as it permits nesting of a pair of the trays. As seen, a bottom 12 of an upper tray 10 will rest upon the lips 40 (one shown) of the lower tray 10.

As can be readily understood from the above description and from the drawings, an interlockable, stackable tray according to the present invention permits positive engagement between members of a stack of trays by the use of only a pair of sidewalls, thus permitting the other sidewall to be configured, and even eliminated, as circumstances permits in order to provide at least visual access of the contents of a tray disposed in a stack of such trays. Further, the manner in which the lowermost tray is supported and/or manipulated will not affect the interlocked relationship between the stacked trays.

While the principles of the invention have now been made clear in the illustrated embodiment, there will be immediately obvious to those skilled in the art, many modifications of structure, arrangements, proportions, the elements, materials and components used in the practice of the invention, and otherwise, which are particularly adapted for specific environments and operation requirements, without departing from those principles. The appended claims are therefore intended to cover and embrace any such modifications within the limits only of the true spirit and scope of the invention.

What I claim is:

1. An interlocking stackable tray comprising:

(a) a bottom wall of planar configuration and having an opposed pair of substantially parallel side edges; and (b) a pair of sidewalls extending integrally and generally upwardly from different ones of the pair of side edges of said bottom wall, said pair of sidewalls being inwardly deflectable toward each other into interlocking supporting engagement with a like tray upon stacked placement of the like tray thereon, each sidewall of said pair of sidewalls including, I. a planar section extending angularly upwardly and inwardly from its respective one of the pair of side edges of said bottom wall and defining an upper end, II. a ledge extending outwardly from the upper end of said planar section and normally lying in a plane which slopes angularly and downwardly relative to the plane of said bottom wall so that when the like tray is stackingly placed on said sidewall, the force resulting from the weight of the like tray will be concentratingly exerted on the upper end of said planar section to inwardly deflect said sidewall which moves said ledge into supporting contiguous engagement with the bottom wall of the like tray adjacent one of its pair of side edges, said ledge having an outer end, III. a lip extending generally upwardly from the outer end of said ledge for movement with said sidewall into gripping engagement with the one of the pair of side edges of the bottom wall of the like tray upon stacked placement of the like tray on said sidewall.

2. An interlocking stackable tray as claimed in claim 1 wherein each of said pair of sidewalls is free standing.

3. An interlocking stackable tray as claimed in claim 1 wherein each of said pair of sidewalls is free standing and extends substantially the full length of its respective one of the pair of side edges of said bottom wall.

4. An interlocking stackable tray as claimed in claim 1 wherein said tray is formed of resiliently deflectable material.

5. An interlocking stackable tray as claimed in claim 1 and further comprising:

(a) said bottom wall having an opposed pair of substantially parallel end edges which are substantially perpendicular with respect to the pair of side edges thereof; and (b) a free standing end wall extending upwardly from one of the pair of end edges of said bottom wall.

6. An interlocking stackable tray as claimed in claim 5 wherein said end wall extends upwardly from said bottom wall a distance which is less than the distance that said pair of sidewalls extend upwardly therefrom.

7. An interlocking stackable tray as claimed in claim 1 and further comprising:

(a) said bottom wall having an opposed pair of substantially parallel end edges which are substantially perpendicular to the pair of side edges thereof; and (b) a pair of free standing end walls each extending upwardly from a different one of the pair of end edges of said bottom wall.

8. An interlocking stackable tray as claimed in claim 7 wherein each of said pair of end walls extends upwardly from said bottom wall a distance which is less than the distance that said pair of sidewalls extend upwardly from said bottom wall.

* * * * *